US006524141B2

(12) United States Patent
Endo

(10) Patent No.: US 6,524,141 B2
(45) Date of Patent: Feb. 25, 2003

(54) CABLE TERMINAL CONNECTING STRUCTURE OF BATTERY

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/877,076

(22) Filed: Jun. 11, 2001

(65) Prior Publication Data

US 2001/0053639 A1 Dec. 20, 2001

(30) Foreign Application Priority Data

Jun. 9, 2000 (JP) ..... 2000-173328

(51) Int. Cl.[7] ..... H01R 4/50
(52) U.S. Cl. ..... 439/773; 429/121
(58) Field of Search ..... 439/772, 764, 439/761, 763, 756–760; 429/121, 7, 61, 429

(56) References Cited

U.S. PATENT DOCUMENTS 1,808,775 A * 6/1931 Hofman ..... 439/760
4,125,683 A * 11/1978 Becford et al. ..... 429/121
4,555,159 A * 11/1985 Chartrain et al. ..... 439/756
4,634,642 A * 1/1987 Lopez-Doriga ..... 429/121
5,389,462 A * 2/1995 Lin ..... 429/121
5,389,466 A * 2/1995 Inoue et al. ..... 439/761
5,556,309 A * 9/1996 Sharpe et al. ..... 439/759
5,575,693 A * 11/1996 Dykas et al. ..... 439/773

FOREIGN PATENT DOCUMENTS

EP 0 575 964 A1 12/1993
EP 0 896 389 A1 2/1999
EP 0 969 558 A1 1/2000
JP 6-5109 1/1994 ..... H01M/2/30

* cited by examiner

*Primary Examiner*—Brian Sircus
*Assistant Examiner*—J. F. Duverne
(74) *Attorney, Agent, or Firm*—Sughrue Mion, PLLC

(57) ABSTRACT

A terminal fitting includes: a first portion which is secured to a cable; a second portion which has a substantially U-shape in which a first end thereof is integrally connected to the first portion, and an electrode post is fitted therein; and a third portion which is extended from a second end of the U-shaped second portion so as to across the first end of the second portion. A locking lever is pivotally supported on the third portion of the terminal fitting. The locking lever includes a cam portion having a cam face which is eccentric with respect to a pivotal center of the locking lever so that the cam face deforms the first end of the second portion of the terminal fitting so as to fasten the electrode post, in cooperation with a pivotal movement of the locking lever. A positioning member is provided on a battery body so as to always retain the first portion of the terminal fitting at a predetermined position.

6 Claims, 6 Drawing Sheets

CABLE TERMINAL CONNECTING STRUCTURE OF BATTERY

BACKGROUND OF THE INVENTION

This invention relates to a cable terminal connecting structure of that portion of a power battery (particularly for mounting on an automobile) at which wire/cable ends are connected to positive and negative electrode posts.

One example of related connecting structures of the type described is a battery terminal disclosed in Japanese Utility Model Publication No. 6-5109U. This is shown in FIGS. 7A and 7B.

Positive and negative electrode posts 1 extend upright from a battery body, and each cable 2 is connected to a respective one of the positive and negative electrode posts 1 through a terminal fitting 3 secured to an end of the cable 2.

The terminal fitting 3 includes a curved portion 3*a* for being fastened tight on the electrode post 1, and one end portion and the other end portion of this curved portion extend outwardly in parallel with each other, and a distal end portion of the one end portion is formed into a clamping portion 3*b* while the other distal end portion is provided as a free end portion 3*c* , the clamping portion 3*b* and the free end portion 3*c* being molded integrally with the curved portion. A bracket 4 extends from the one end portion at which the clamping portion 3*b* is provided, and a locking lever 5 is pivotally mounted on this bracket 4 through a pivot pin 5*a*.

The clamping portion 3*b* is fixedly secured to a conductor 2*a* of the cable end portion, exposed by removing an insulating sheath therefrom, by press-deforming or the like. The locking lever 5 is held in contact with an outer face of the free end portion 3*c*, and a proximal end portion (in the longitudinal direction) of the lever, pivotally supported by the pivot pin 5*a*, serves as a locking cam portion 5*b* having a cam face 5*c*, whereas a distal end portion (in the longitudinal direction) of the lever is formed into an operating portion 5*d* having a free end.

Therefore, in a provisionally-mounted condition in which the curved portion 3*a* of the terminal fitting 3 is fitted on the electrode post 1, a pressing force is applied to the operating portion 5*d* to pivotally move the locking lever 5 about the pivot pin 5*a* in a clockwise direction indicated by an arrow A in FIG. 7A. The cam face 5*c* of the locking cam portion 5*b* is eccentric with respect to the pivot pin 5*a*, and therefore when the locking lever 5 is operated, a leverage force due to the angular moment acts on the free end portion 3*c* of the terminal fitting 3 to press this free end portion 3*c* toward the one end portion of the terminal fitting 3 having the clamping portion 3*b*. As a result of this pressing operation, the curved portion 3*a* of the terminal fitting 3 is decreased in diameter, and therefore is fastened tight around the electrode post 1 (on which this curved portion has so far been provisionally mounted) in press-contacted relation thereto. By thus completely fastening the curved portion, the connection of the cable 2 to the electrode post 1 through the terminal fitting 3 is completed.

The related structure, shown in FIGS. 7A and 7B, has the following problem.

When the locking lever 5 is pivotally moved in the direction of the arrow A so as to completely fasten the terminal fitting 3, provisionally mounted on the electrode post 1, thereon in a press-contacted manner for locking purposes, the terminal fitting 3 turns together with the locking lever in the same direction by this pivotal force, so that the cable 2 is displaced. In order to avoid this, the operator, while holding the terminal fitting 3 against movement with one hand, applies a pressing force to the operating portion 5*d* of the locking lever 5 by the other hand. Thus, the fastening operation must be effected with both hands while correcting the posture of the terminal fitting 3 so that this terminal fitting will not be moved or displaced, and this operation is cumbersome.

SUMMARY OF THE INVENTION

It is therefore an object of this invention to provide a cable terminal connecting structure of a battery in which when connecting a cable to an electrode post through a terminal fitting, the terminal fitting in a provisionally-mounted condition will not be turned into an unstable posture by an operating force, used for locking the terminal fitting to the electrode post, thereby enhancing the efficiency of the connecting operation.

In order to achieve the above object, according to the present invention, there is provided a structure for connecting a cable with an electrode post provided on a battery body, comprising:

a terminal fitting, including:

- a first portion which is secured to the cable;
- a second portion which has a substantially U-shape in which a first end thereof is integrally connected to the first portion, and the electrode post is fitted therein; and
- a third portion which is extended from a second end of the U-shaped second portion so as to across the first end of the second portion;
- a locking lever, pivotally supported on the third portion of the terminal fitting, the locking lever including a cam portion having a cam face which is eccentric with respect to a pivotal center of the locking lever so that the cam face deforms the first end of the second portion of the terminal fitting so as to fasten the electrode post, in cooperation with a pivotal movement of the locking lever; and
- a positioning member, provided on the battery body so as to always retain the first portion of the terminal fitting at a predetermined position.

Here, it is preferable that the positioning member includes a pair of plate members which are placed both sides portion of the first portion of the terminal fitting so as to extend therealong.

In this configuration, the terminal fitting is positioned relative to the electrode post and the positioning member on the battery body, and therefore is set in the provisionally-mounted condition, and then the terminal fitting is fastened tight around the electrode post in the locked condition by pivotally moving the locking lever. Namely, in the operation for pivotally moving the locking lever from the provisionally-mounted condition to the locked condition, the terminal fitting is always kept in a stable posture, and therefore the terminal fitting will not turn together with the lever when the locking lever is operated, and thus this inconvenience of the operation is overcome, and the operator can effect the operation with one hand.

Preferably, the locking lever is made of a resin material. In this configuration, the locking lever can be suitably elastically deformed during the time when the locking lever is pivotally moved from the provisionally-mounted condition to the locked condition, and in cooperation with the deformation of the terminal fitting pressed by the cam portion, the deformation, inherent to the resin material, can cause the terminal fitting to be fastened tight around the electrode post.

Preferably, the locking lever includes a cover body which wholly accommodates the terminal fitting therein when the fastening operation is completed.

Preferably, the cam portion situates in a side of the first end of the second portion of the terminal fitting. And the locking lever includes an operating portion to pivot the cam portion to perform the fastening operation, which situates a side of the second end of the second portion of the terminal fitting.

In this configuration, the angular moment of the locking lever can be converted into a leverage force, and therefore the operator can efficiently electrically connect the cable to the electrode post in the locked condition by operating the locking lever with one hand substantially in a one-touch manner.

Here, it is preferable that the operating portion includes a cover body which wholly accommodates the terminal fitting therein when the fastening operation is completed.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

A preferred embodiment of a battery cable terminal connecting structure of the present invention will now be described in detail with reference to the accompanying drawings.

Figure 3:
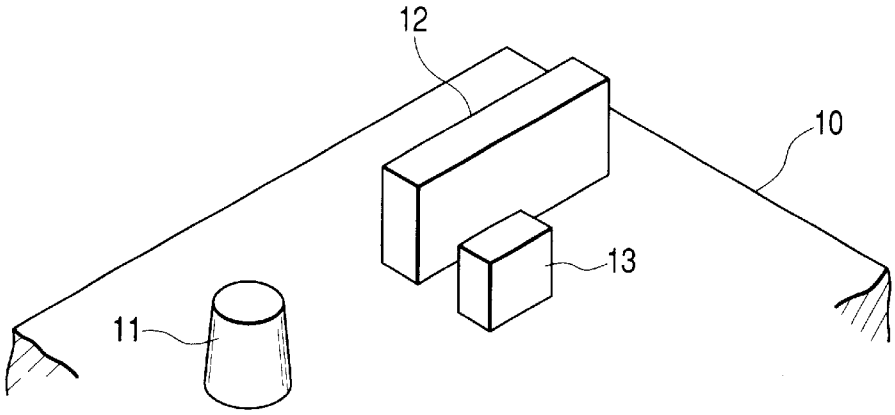
FIG. 3 is a perspective view showing the electrode post and holding plates, formed on a battery body, in the first embodiment.

FIGS. 1 to 4 show the structure according to a first embodiment of the invention. As shown in FIG. 3, electrode posts 11, serving respectively as positive (+) and negative (−) power output terminals, are formed on and extend upright from an upper lid of a battery body 10. Holding plates 12 and 13, serving as positioning members in the invention, are fixedly mounted in the vicinity of each electrode post 11, and these plates serve to prevent a terminal fitting 20 (described later) from being displaced out of position and shaken during the operation so that the posture of the terminal fitting will not become unstable so as to prevent the operation from being adversely affected.

Figure 4:
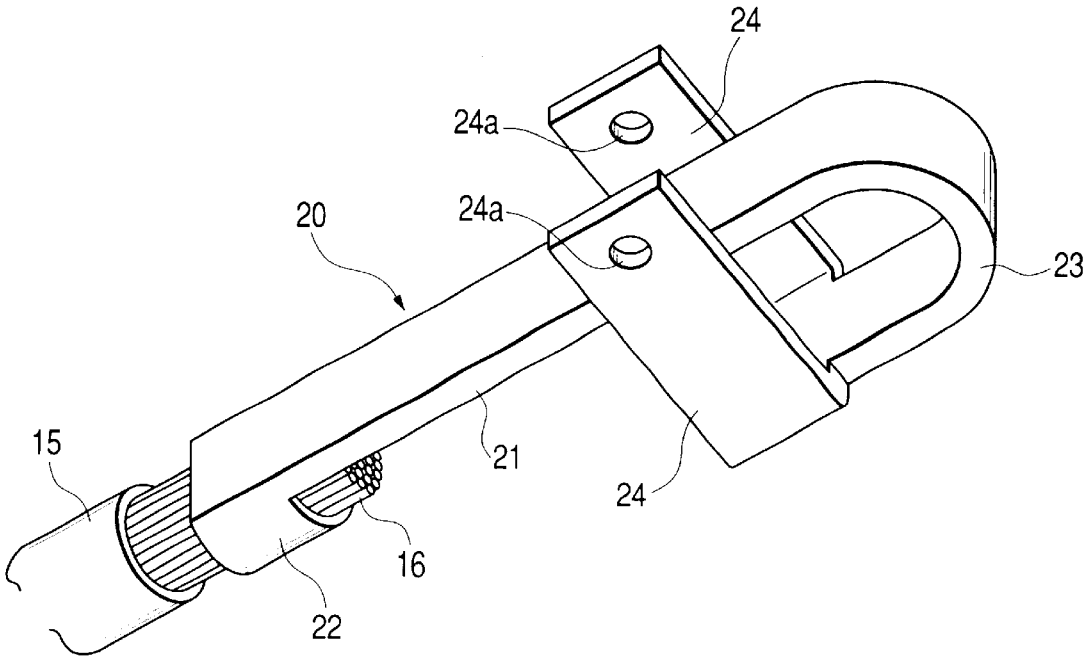
FIG. 4 is a perspective view of the terminal fitting of the first embodiment as seen obliquely from the lower side.

FIG. 4 is a view of the terminal fitting 20, fixedly secured to an end of a cable 15 (which is to be connected to each of the positive and negative electrode posts 11) as seen obliquely from the lower side. An insulating sheath is removed from the end portion of the cable 15, so that a conductor 16 is exposed at this end portion. A clamping portion 22, formed at a proximal end of a metal body 21 of the terminal fitting 20, is fixedly secured to the conductor 16 by press-deforming or the like. A curved portion 23 is formed at a distal end of the metal body 21. An interconnecting arms 24 is extended from a distal end portion of the curved portion 23 so as to intersect a proximal end portion of the curved portion 23. A pin hole 24*a* is formed through each of these interconnecting arms 24.

Figure 1B:
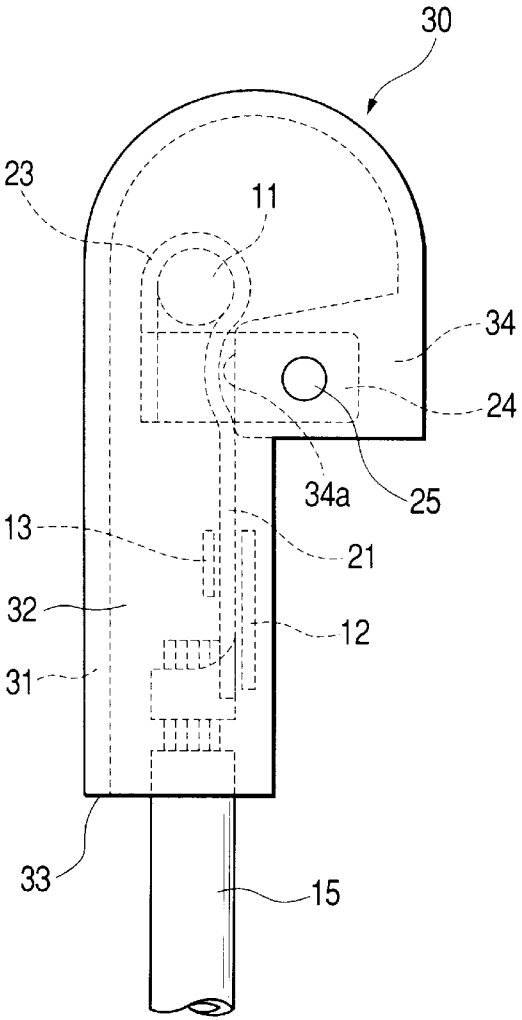
FIG. 1B is a similar plan view, but showing a condition after the locking connection.
Figure 1A:
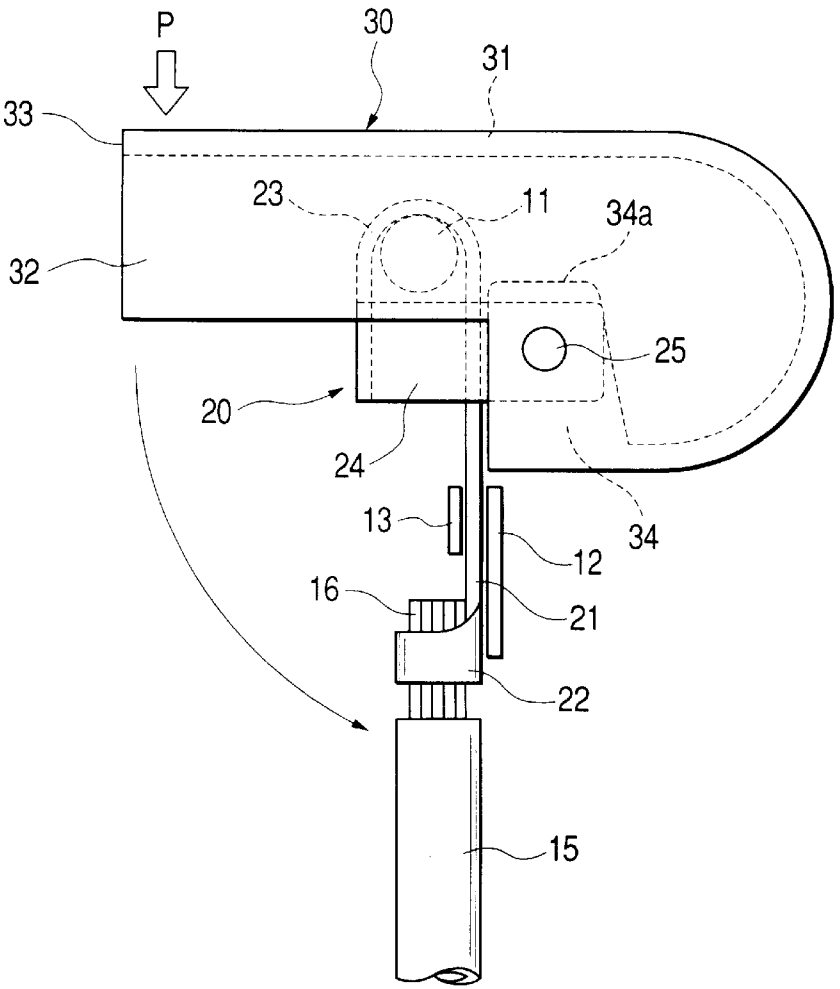
FIG. 1A is a plan view of a terminal connecting structure according to a first embodiment of the present invention, showing a condition before a locking connection.
Figure 2:
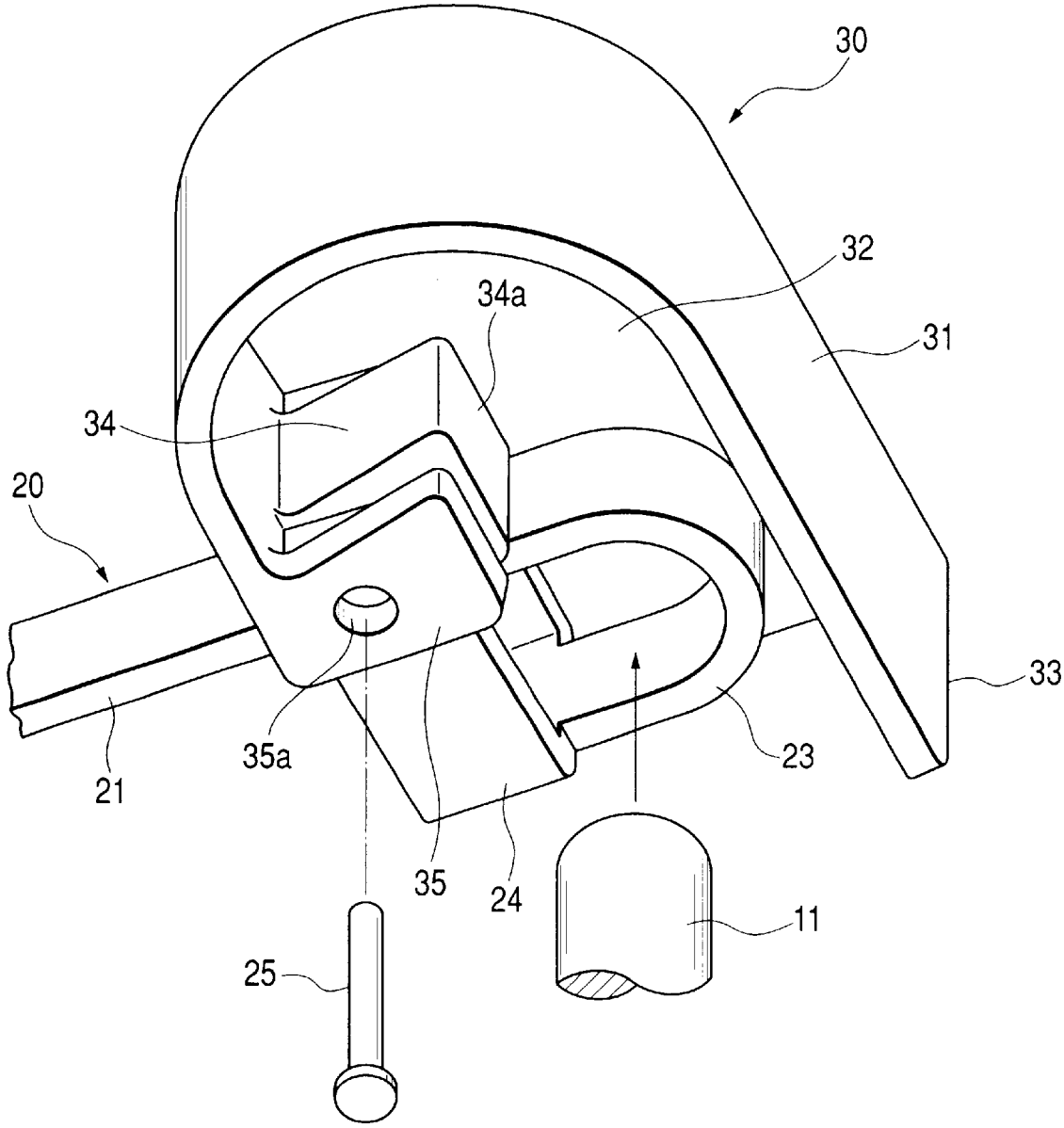
FIG. 2 is a perspective view showing the arrangement of a terminal fitting and a locking lever relative to an electrode post in the first embodiment, as seen obliquely from the lower side.

As shown in FIGS. 1A and 1B, a locking lever 30 is pivotally mounted on distal ends of the interconnecting arms 24 of the terminal fitting 20 through a pivot pin 25.

The locking lever 30 is, for example, molded of a resin, and this locking lever 30 of an elongate cap-shape includes, as main portions, a side wall portion 31, and a top wall portion 32 disposed perpendicular to this side wall portion 31. A thick locking cam portion 34 is formed integrally at a proximal end portion of this cap-shape locking lever, and is spaced from a bracket portion 35, formed outwardly of this locking cam portion 34, by such a distance that the interconnecting arm 24 of the terminal fitting 20 can be fitted in the gap between the locking cam portion 34 and the bracket portion 35. A pin hole 35*a* is formed through the bracket portion 35, and a pin hole, aligned with the pin hole 35*a*, is also formed through the locking cam portion 34.

One of the interconnecting arms 24 of the terminal fitting 20 is inserted between the locking cam portion 34 and the bracket portion 35, and is connected thereto by the pivot pin 25 for pivotal movement relative to them. Similarly, the other interconnecting arm 24 is inserted between the locking cam portion 34 and the top wall portion 32, and is pivotally connected thereto by the pivot pin 25. The locking cam portion 34, defined by the thickened molded portion, has a cam face 34*a* eccentric with respect to the axis of the pivot pin 25, and this cam face 34*a* is held in contact with an outer face of the proximal end of the curved portion 23 of the terminal fitting 20, that is, an outer face of the distal end portion of the metal body 21.

The distal end portion of the cap-shaped locking lever 30 serves as an operating portion 33 at which the side wall portion 31 and the top wall portion 32 are perpendicularly intersect with each other. In FIG. 1A which is a plan view showing a condition before the locking connection, a pivotal force, indicated by an arrow P, is applied to the operating portion 33 such that the distance between the operating portion 33 and the pivot pin 25 defines a radius of pivotal movement. The whole of the locking lever 30 can be pivotally moved about the pivot pin 25 in a counterclockwise direction (FIG. 1A), that is, in a locking direction, by this pivotal force P.

Next, in the cable terminal connecting structure of this embodiment having the above construction, the assembling and locking operations for electrically connecting the cable 15 to the electrode post 11 on the battery body 10 will be described.

For connecting each cable 15 to a respective one of the electrode posts 11 on the battery body 10, there is prepared the cable in which the insulating sheath is beforehand removed from the end portion of this cable 15 to expose the conductor 16, and the clamping portion 22 of the terminal fitting 20 is fixedly secured to this conductor 16 by press-deforming or the like.

As shown in FIG. 1A, the thus prepared cable 15 is located near to the electrode post 11, and the metal body 21 of the terminal fitting 20 is inserted between the holding plates 12 and 13 on the battery body 10, and therefore is positioned. As a result, the metal body 21 is kept in a stable posture, and will not be displaced out of position, so that the processing can efficiently proceed to the next stage, that is, the fastening operation (i.e., the locking operation). At this time, the curved portion 23 at the distal end of the metal body 21 is fitted on the electrode post 11 from the upper side, and is set in a provisionally-mounted condition.

Then, in this condition in which the terminal fitting 20 is provisionally mounted on the electrode post 11, the pivotal force P is applied to the operating portion 33 of the locking lever 30 to pivotally move this locking lever 30 about the pivot pin 25 in the counterclockwise direction. At this time, the locking cam portion 34 is angularly moved in the same direction, and therefore the cam face 34*a* is displaced by the angular moment to apply a pressing force to the outer side (i.e., the mating contact face) of the metal body 21 of the terminal fitting 20 by a leverage force corresponding to the distance of eccentricity from the pivot pin 25.

When the cam face 34*a* imparts the pressing force to the metal body 21, the metal body 21 is resiliently deformed to be curved inwardly, and therefore the curved portion 23 is resiliently deformed to be contracted in a diameter-decreasing direction.

FIG. 1B shows a stage at which the locking lever 30 has been pivotally moved about the pivot pin 25 through an angle of about 90 degrees to reach a locked position, thereby causing the above resilient deformation, and the pressing of the cam face 34*a* of the locking cam portion 34 against the terminal fitting 20 has been completed. At this time, the curved portion 23 of the terminal fitting 20 is deformed to be reduced in diameter, and therefore is fastened tight on the electrode post 11, and therefore the terminal fitting 20 is connected to the electrode post in a locked condition, so that the electrical connection of the cable 15 to the electrode post 11 is completed.

Figure 7A:
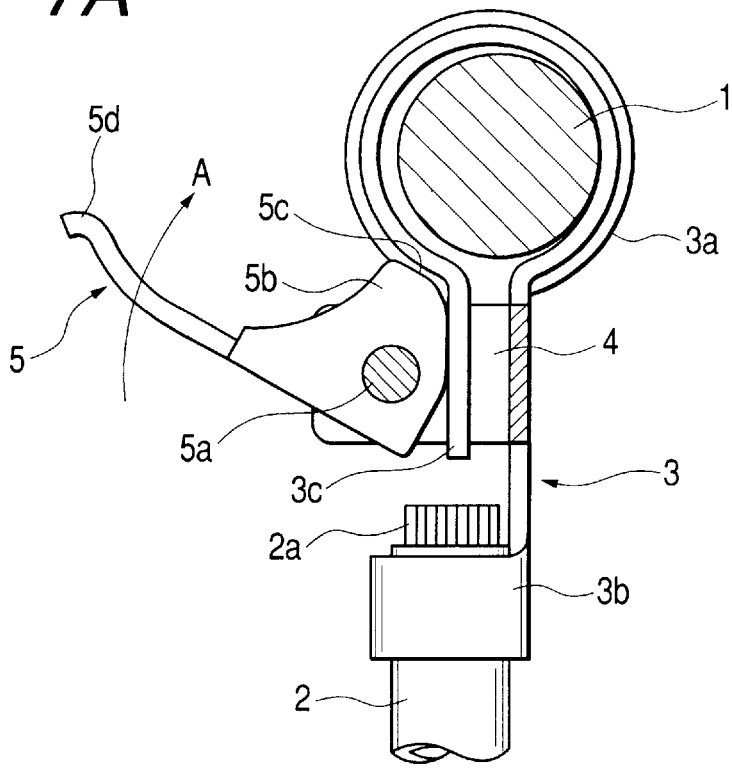
FIG. 7A is a plan view of a related terminal connecting structure, showing a condition before a locking connection.
Figure 7B:
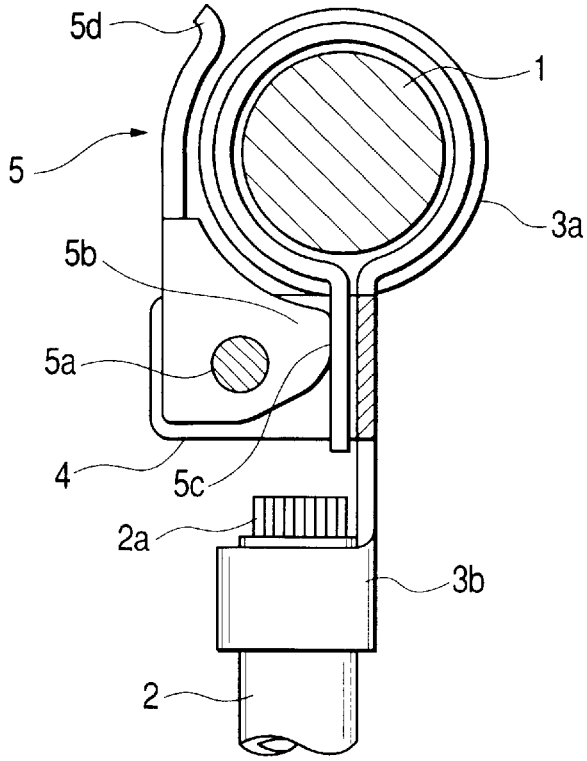
FIG. 7B is a similar plan view, but showing a condition after the locking connection.

As will be appreciated from the above operation and effects, the sequential operation for pivotally moving the locking lever from the provisionally-mounted condition (in which the terminal fitting is engaged with the post 11 and the holding plates 12 and 13 on the battery body 10) to the locked condition by pivotally moving the locking lever 30 through the angle of about 90 degrees, can be effected not with both hands of the operator but with either hand. Namely, in the related construction shown in FIGS. 7A and 7B, since the metal body turns together with the lever when operating the lever, the lever must be operated with one hand while holding the cable, connected to the metal body, with the other hand. This inconvenience of the operation can be overcome, and therefore the efficiency of the operation can be enhanced.

Figure 5B:
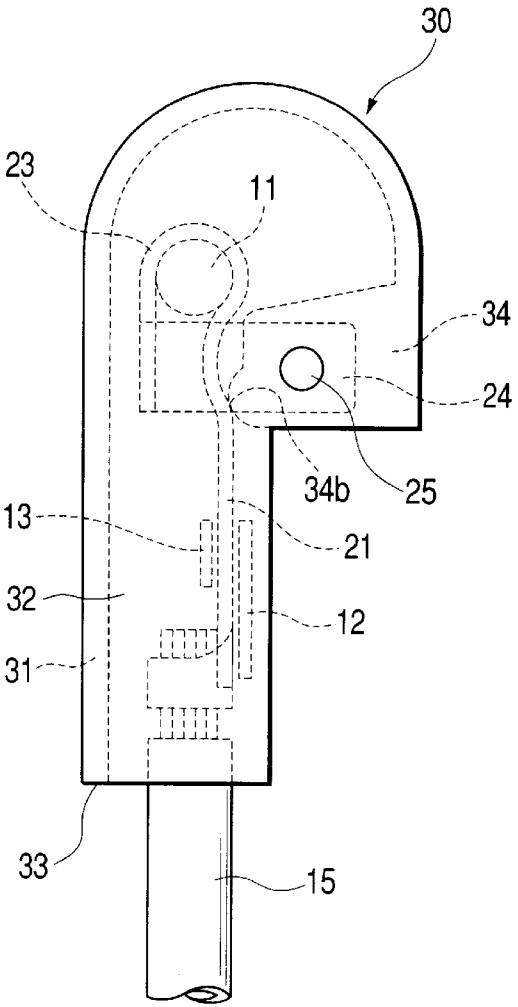
FIG. 5B is a similar plan view, but showing a condition after the locking connection.
Figure 5A:
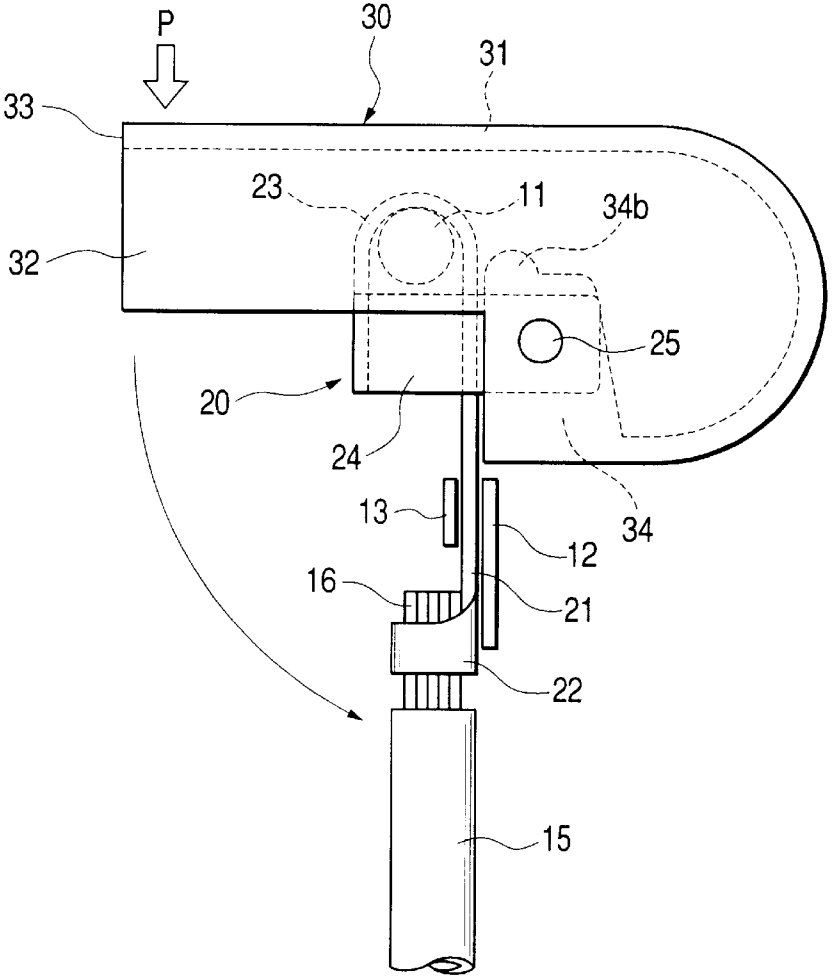
FIG. 5A is a plan view of a terminal connecting structure according to a first embodiment of the present invention, showing a condition before a locking connection.
Figure 6:
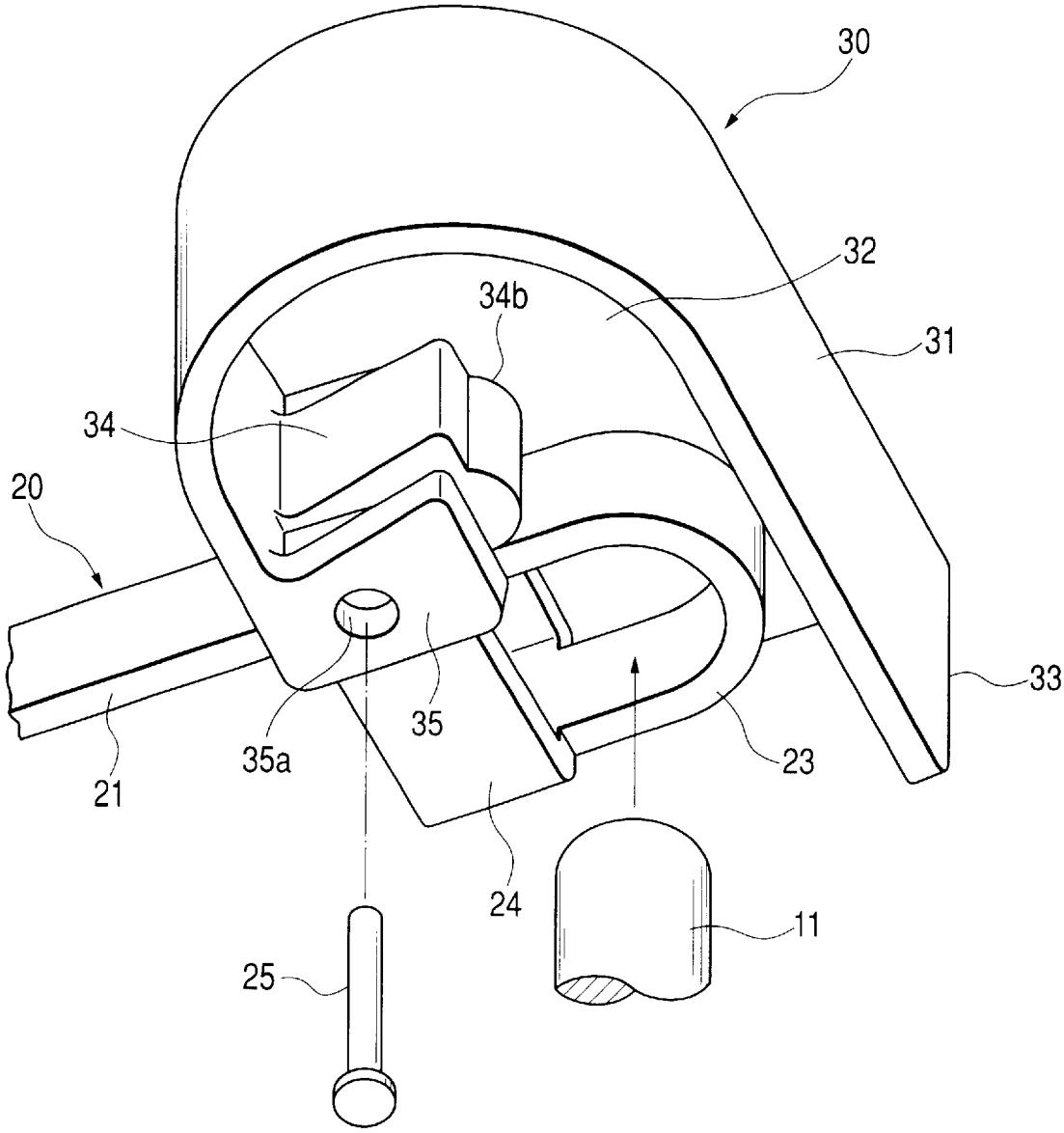
FIG. 6 is a perspective view showing the arrangement of a terminal fitting and a locking lever relative to an electrode post in the second embodiment, as seen obliquely from the lower side.

FIGS. 5A and 5B show a terminal connecting structure according to a second embodiment of the invention which is an improved configuration of the above first embodiment.

In this embodiment, instead of the cam face 34*a*, a cam convex portion 34*b* is formed on and projects from the locking cam portion 34 formed on the locking lever 30 of the first embodiment. The other detailed structures are the same as in the first embodiment, and identical reference numerals denote corresponding members and portions.

Thanks to the provision of the cam convex portion 34*b* on the locking cam portion 34, a leverage force acts on the curved portion 23 of the terminal fitting 20 in a concentrated manner through the cam convex portion 34*b* in a completely locked condition shown in FIG. 5B, and therefore the curved portion 23 can be deformed to be fastened on the electrode post 11 more efficiently.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A structure for connecting a cable with an electrode post provided on a battery body, comprising:

a terminal fitting, including:

a first portion which is secured to the cable;

a second portion which has a substantially U-shape in which a first end thereof is integrally connected to the first portion, and the electrode post is fitted therein; and a third portion which is extended from a second end of the U shaped second portion across the first end of the second portion;

a locking lever, pivotally supported on the third portion of the terminal fitting, the locking lever including a cam portion having a cam face which is eccentric with respect to a pivotal center of the locking lever so that the cam face deforms the first end of the second portion of the terminal fitting so as to fasten the electrode post, in cooperation with a pivotal movement of the locking lever; and a positioning member, provided on the battery body so as to receive a force generated by the fastening of the locking lever for retaining the first portion of the terminal fitting at a predetermined position.

2. The connecting structure as set forth in claim 1, wherein the locking lever is made of a resin material.

3. The connecting structure as set forth in claim 1, wherein the locking lever includes a cover body which wholly accommodates the terminal fitting therein when the fastening operation is completed.

4. The connecting structure as set forth in claim 1, wherein the cam portion situates in a side of the first end of the second portion of the terminal fitting; and wherein the locking lever includes an operating portion to pivot the cam portion to perform the fastening operation, which situates a side of the second end of the second portion of the terminal fitting.

5. The connecting structure as set forth in claim 4, wherein the operating portion includes a cover body which wholly accommodates the terminal fitting therein when the fastening operation is completed.

6. The connecting structure as set forth in claim 1, wherein the positioning member includes a pair of plate members which are placed both sides portion of the first portion of the terminal fitting so as to extend therealong.

* * * * *